US009330636B1

(12) United States Patent
Chang

(10) Patent No.: US 9,330,636 B1
(45) Date of Patent: May 3, 2016

(54) TURNING PEG STRUCTURE EQUIPPED WITH CHANGEABLE PANEL

(71) Applicant: PING WELL INDUSTRIAL CO., LTD., Taichung (TW)

(72) Inventor: Tsung-Min Chang, Taichung (TW)

(73) Assignee: PING WELL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 14/509,649

(22) Filed: Oct. 8, 2014

(51) Int. Cl.

| | |
|---|---|
| ***G10D 3/14*** | (2006.01) |
| ***G10D 3/00*** | (2006.01) |
| ***G10D 1/00*** | (2006.01) |
| ***G10D 1/02*** | (2006.01) |
| ***G10D 1/08*** | (2006.01) |
| ***G10D 3/12*** | (2006.01) |
| *G10D 1/10* | (2006.01) |
| *G10D 1/06* | (2006.01) |

(52) U.S. Cl.
CPC .. *G10D 3/14* (2013.01); *G10D 3/00* (2013.01); *G10D 3/12* (2013.01); *G10D 1/00* (2013.01); *G10D 1/02* (2013.01); *G10D 1/06* (2013.01); *G10D 1/08* (2013.01); *G10D 1/10* (2013.01); *G10D 3/143* (2013.01)

(58) Field of Classification Search
CPC ..... G10D 3/14; G10D 3/00
USPC ..... 84/304, 305, 306
See application file for complete search history.

(56) References Cited

U.S. PATENT DOCUMENTS

| | | | | | |
|---|---|---|---|---|---|
| 1,561,566 | A * | 11/1925 | Purdy | G10D 3/14 | 74/10.54 |
| 1,579,987 | A * | 4/1926 | Wickes | G10D 3/14 | 84/305 |
| 1,669,823 | A * | 5/1928 | Grover | G10D 3/14 | 84/306 |
| 2,838,974 | A * | 6/1958 | Fender | G10D 3/14 | 84/306 |
| 3,023,658 | A * | 3/1962 | Gusey | G10D 3/14 | 192/12 R |
| 4,077,295 | A * | 3/1978 | Zapp | G10D 3/14 | 84/304 |
| 4,191,086 | A * | 3/1980 | Spercel | G10D 3/14 | 84/306 |
| 5,998,713 | A * | 12/1999 | Herin | G10D 3/14 | 84/304 |
| 6,172,287 | B1 * | 1/2001 | Kang | G10D 3/14 | 84/304 |
| 6,781,048 | B1 * | 8/2004 | Royce | G10D 3/006 | 84/453 |
| 7,816,594 | B2 * | 10/2010 | Vochezer | G10D 3/14 | 84/305 |
| 8,367,915 | B1 * | 2/2013 | Chang | G10D 3/14 | 84/304 |
| 2006/0117929 | A1 * | 6/2006 | Gotoh | G10D 3/14 | 84/304 |
| 2007/0012157 | A1 * | 1/2007 | D'Addario | G10D 3/006 | 84/304 |
| 2007/0295186 | A1 * | 12/2007 | Goto | G10D 3/14 | 84/304 |
| 2010/0242704 | A1 * | 9/2010 | Goto | G10D 3/14 | 84/304 |
| 2013/0036891 | A1 * | 2/2013 | Alsmeyer | G10D 3/006 | 84/304 |
| 2015/0161971 | A1 * | 6/2015 | Lee | G10C 3/10 | 84/304 |

* cited by examiner

*Primary Examiner* — David Warren
*Assistant Examiner* — Christina Schreiber
(74) *Attorney, Agent, or Firm* — Muncy, Geissler, Olds & Lowe PC

(57) ABSTRACT

A turning peg structure equipped with changeable faceplate to drive a winding shaft assembly of a string instrument to adjust the tightness of a string. The turning peg structure includes a bracket, at least one first faceplate, at least one second faceplate and a linking rod. The bracket includes a plate and a passage embedded in and run through the plate. The plate includes a first side and a second side opposite to the first side. The first faceplate includes a first connecting portion connected to the first side of the bracket. The second faceplate includes a second connecting portion connected to the second side of the bracket. The linking rod has one end located in the passage and another end engaged with the winding shaft assembly. Through the bracket, the turning peg structure does not lose string adjustment function due to damage thereof.

4 Claims, 9 Drawing Sheets

TURNING PEG STRUCTURE EQUIPPED WITH CHANGEABLE PANEL

FIELD OF THE INVENTION

The present invention relates to a string instrument structure and particularly to a turning peg structure equipped with changeable panel.

BACKGROUND OF THE INVENTION

String instruments are one of mainstream musical instrument types, and include classic guitar, cello, viola, violin and ukulele that are commonly seen. They generate sound through resonance of strings and a sound chest. By adjusting the looseness and tightness of the strings the tone generated also can be adjusted to allow performers to produce precise notes.

To facilitate adjustment of the looseness and tightness of the strings a general string instrument includes a turning peg structure as shown in FIG. 1. The turning peg structure includes an adjustment stem 1 to drive turning of a string, a turning peg 2 to allow users to turn the adjustment stem 1 and a connecting rod 3 to bridge the adjustment stem 1 and the turning peg 2. The connecting rod 3 is inserted into the turning peg 2 to form secure fastening. When the turning peg 2 is turned the connecting rod 3 drives the adjustment stem 1 to adjust the looseness and tightness of the string.

During transportation or performance incidental impact or dropping often is unavoidable. Then performers have to redo the adjustment of the looseness and tightness of the strings to make sure that the playing tone is accurate. In the event that the impact has caused damage of the turning peg 2 and results in exposure of the connecting rod, adjustment of the tone cannot be done, and performance quality is affected, or the performance could even be interrupted.

To solve the aforesaid problem the turning peg 2 made of different materials has been developed and introduced. Usually metal with stronger strength is used to replace the wood or plastics for the material of the turning peg 2. However, the metal provides merely a single color hue and cannot present performer's personal style, hence it is not the preferred choice of many performers.

SUMMARY OF THE INVENTION

The primary object of the present invention is to avoid the problem of unable to adjust string tightness after the turning pegs are damaged.

To achieve the foregoing object the present invention provides a turning peg structure equipped with changeable panel to drive a winding shaft assembly of a string instrument and adjust the tightness of a string. The turning peg structure includes a bracket, at least one first panel, at least one second panel and a connecting rod. The bracket includes a plate and a passage embedded in the plate and run through thereof. The plate includes a first side and a second side opposite to the first side. The first panel includes a first connecting portion connected to the first side of the bracket and a first ornamental portion located at one side thereof remote from the bracket. The second panel includes a second connecting portion connected to the second side of the bracket and a second ornamental portion located at another side thereof remote from the bracket. The connecting rod has one end located in the passage and another end engaged with the winding shaft assembly.

By turning the bracket the connecting rod can be driven, and the winding shaft assembly engaged with the connecting rod also can be driven and turned to draw the string to adjust the tightness thereof. Due to the bracket is made from wood that is sturdier, it is less likely to suffer damage in the event of impact or dropping.

Through the construction set for the above, the invention can provide features as follows:

1. Through the bracket the structural strength of the turning peg structure increases, hence damage caused by external factors such as impact or dropping is less likely to take place.

2. By incorporating the first ornamental portion and the second ornamental portion with the bracket the external appeal of the turning peg structure can be maintained while the structural strength is enhanced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
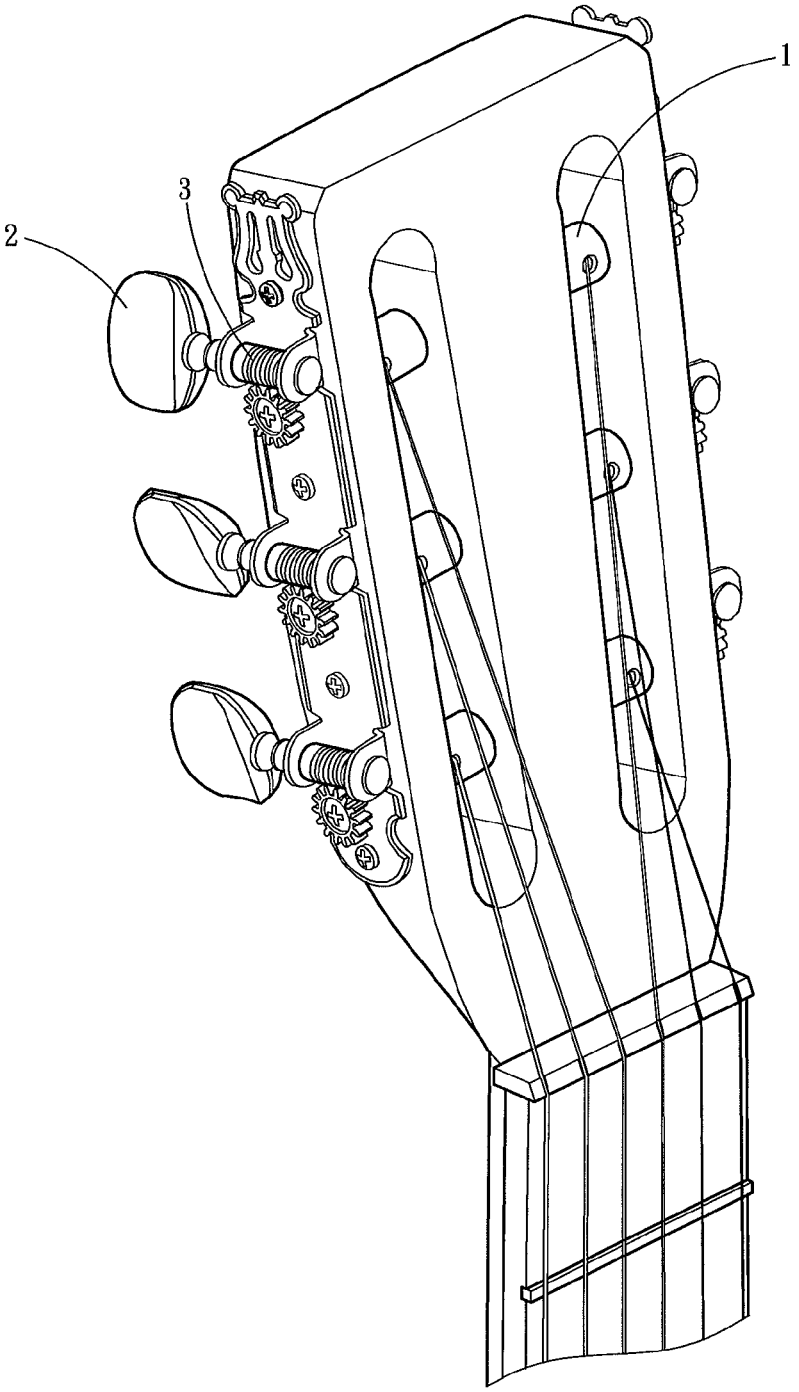
Fig. 1 PRIOR ART
FIG. 1 is a perspective view of a conventional string instrument and a turning peg structure.
Figure 2:
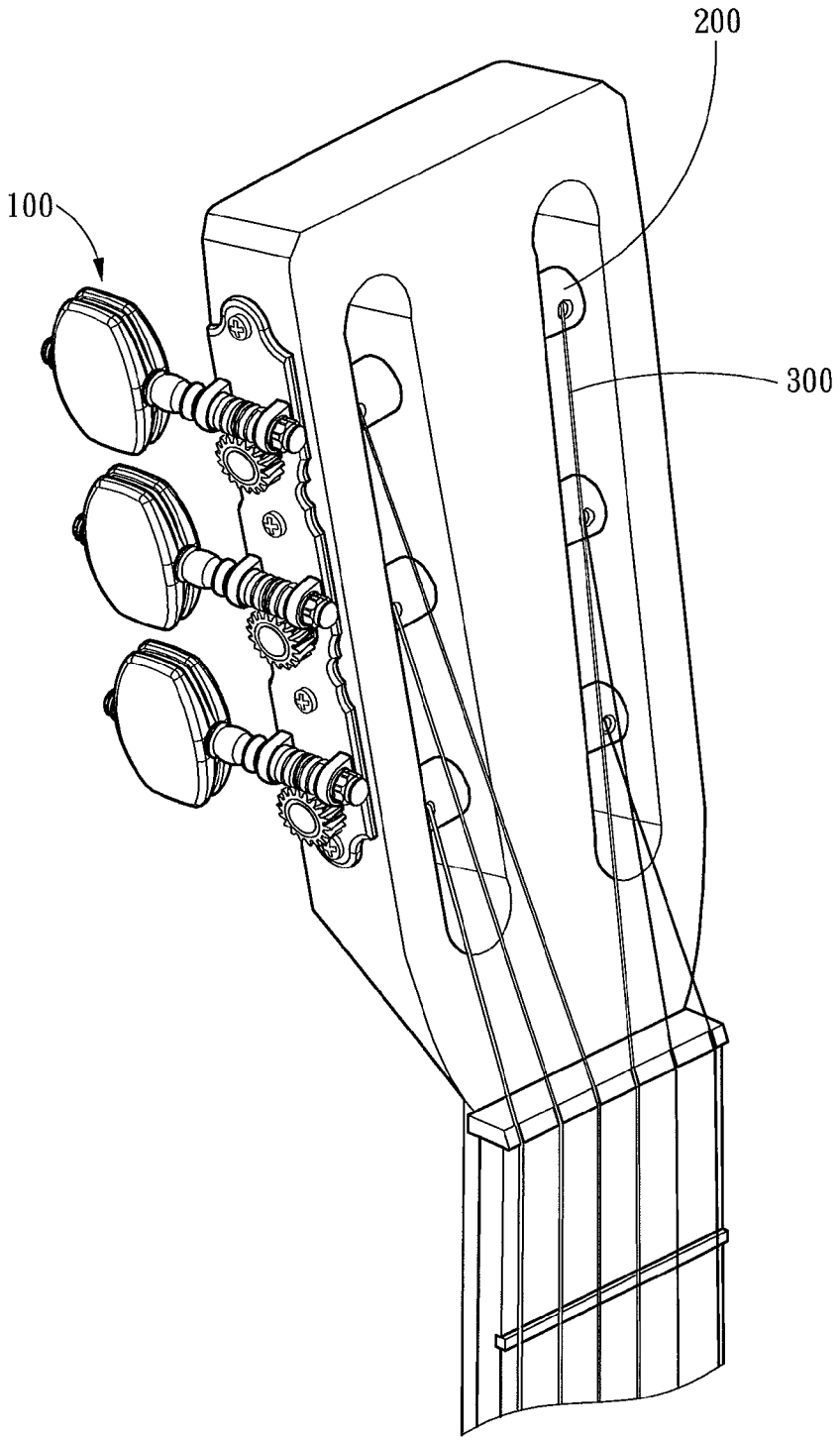
FIG. 2 is a perspective view of the turning peg structure and a string instrument according to the invention.
Figure 3:
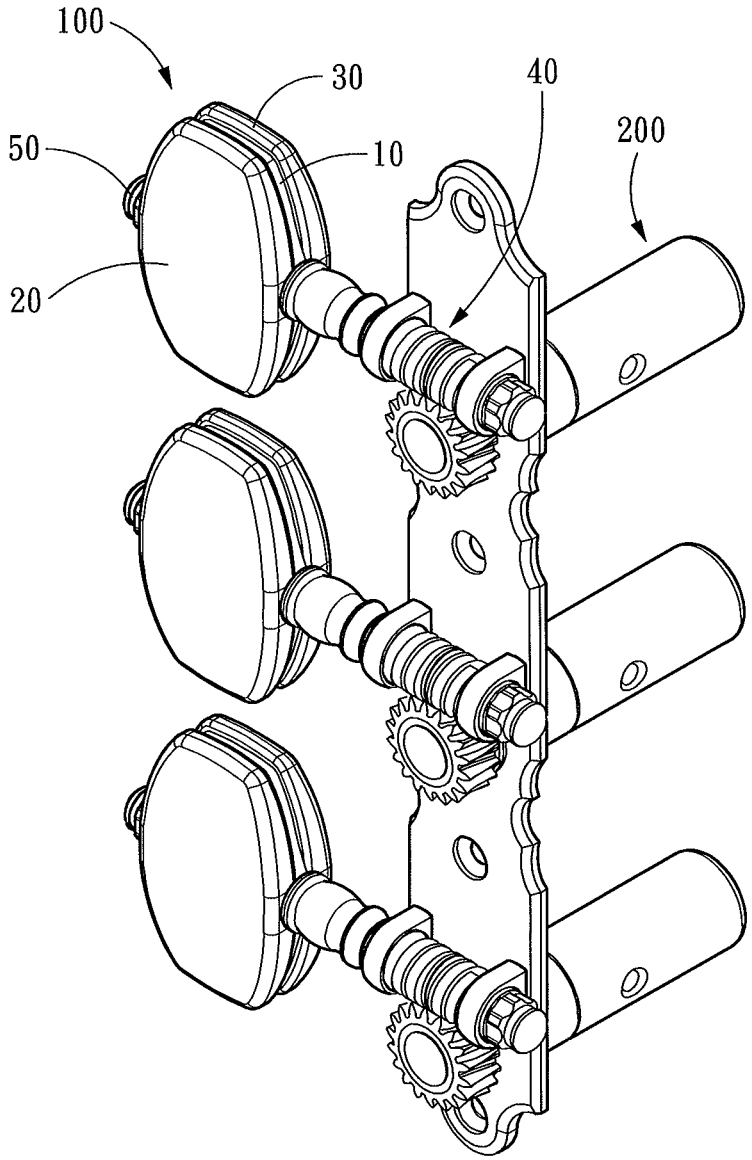
FIG. 3 is a perspective view of the turning peg structure and a winding shaft assembly according to the invention.
Figure 4:
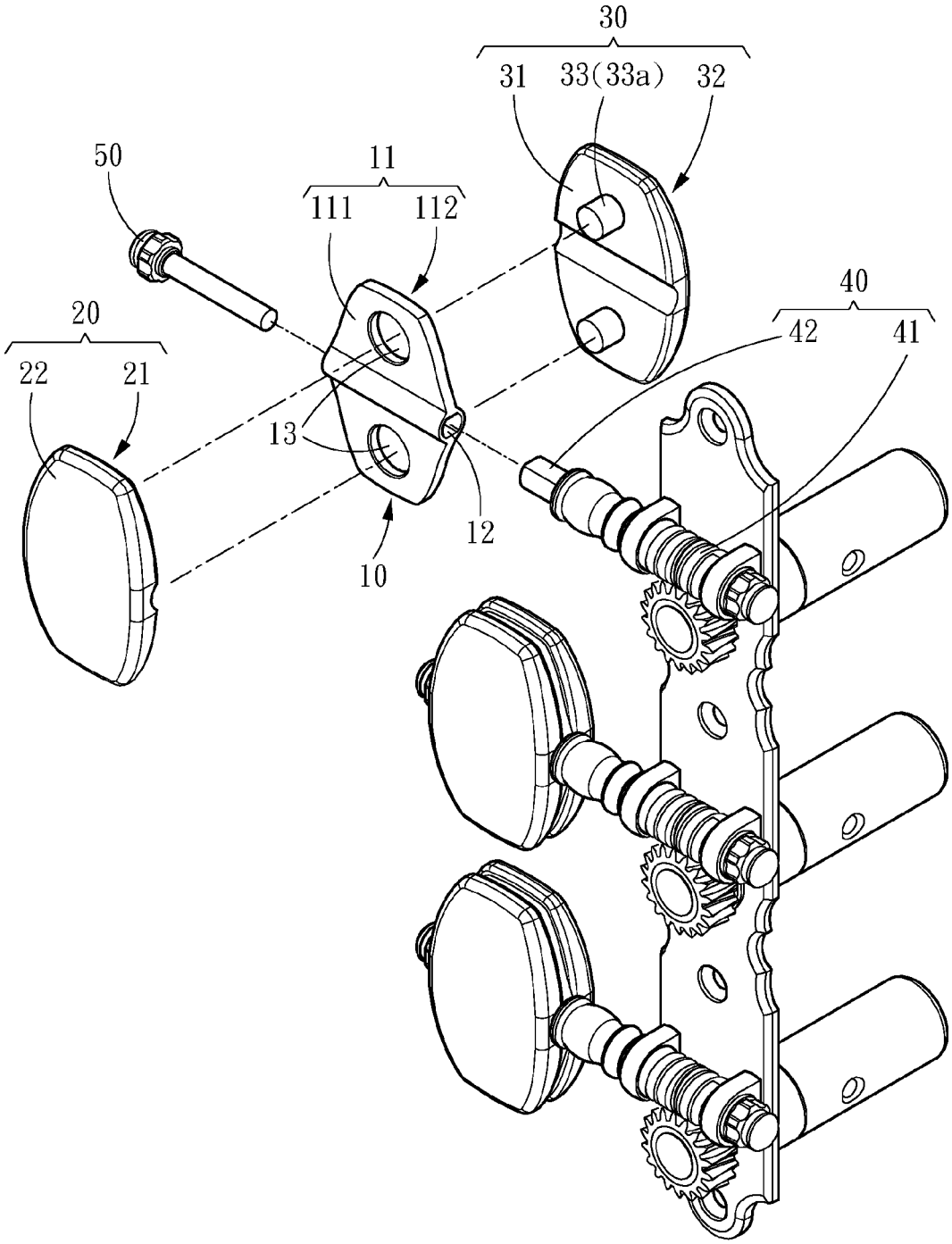
FIG. 4 is an exploded view of the turning peg structure of the invention.
Figure 5:
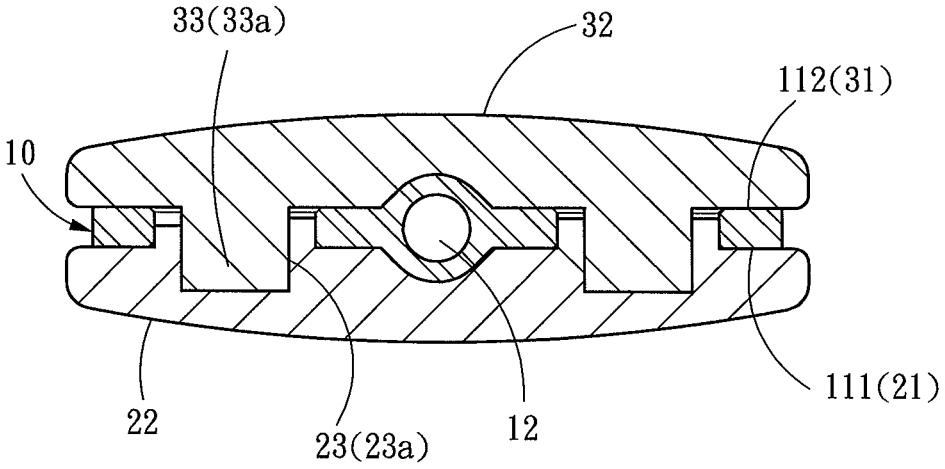
FIG. 5 is a fragmentary sectional view of the turning peg structure of the invention.

Please referring to FIGS. 3, 4 and 5, the present invention aims to provide a turning peg structure 100 with changeable panel to drive a winding shaft assembly 200 and adjust the tightness of a string 300. The turning peg structure 100 includes a bracket 10, at least one first panel 20, at least one second panel 30 and a connecting rod 40. The bracket 10 includes a plate 11 and a passage 12 embedded in the plate 11 and run through thereof. The plate 11 includes a first side 111 and a second side 112 opposite to the first side 111. The first panel 20 includes a first connecting portion 21 connected to the first side 111 of the bracket 10 and a first ornamental portion 22 located at one side remote from the bracket 10. The second panel 30 includes a second connecting portion 31 connected to the second side 112 of the bracket 10 and a second ornamental portion 32 located at another side remote from the bracket 10. The connecting rod 40 has one end located in the passage 12 and another end engaged with the winding shaft assembly 200. Furthermore, the bracket 10 can be made of material that is not easily broken or damaged such as metal or plastics. The first ornamental portion 22 and the second ornamental portion 32 can be made from ornaments preferred by users, such as wood, gems or ambers.

Also referring to FIGS. 4 and 5, the bracket 10 further includes two installation holes 13 symmetrical against the center of the passage 12. The first panel 20 includes two first installation portions 23 located on the first connecting portion 21 corresponding to the two installation holes 13. The second panel 30 includes two second installation portions 33 located on the second connecting portion 31 corresponding to the two first installation portions 23. The two first installation portion 23 and the two second installation portion 33 run through respectively the two installation holes 13 to couple with each other so that the first connecting portion 21 and the second connecting portion 31 are coupled closely with the first side 111 and the second side 112. In addition, in this embodiment the two first installation portions 23 are two sets of coupling holes 23*a*, and the two second installation portions 33 are two sets of coupling struts 33*a* that are formed at a diameter same as that of the two sets of coupling holes 23*a*. Thereby the two sets of coupling struts 33*a* can run through the two sets of coupling holes 23*a* to form tight coupling. When this is a need to change the first panel 20 and the second face plate 30 they can be removed easily. Through the two first installation portions 23 and the two second installation portions 33 the first panel 20 and the second panel 30 can be replaced easily to change the outside look of the turning peg structure 100 to suit user's preference.

Figure 6:
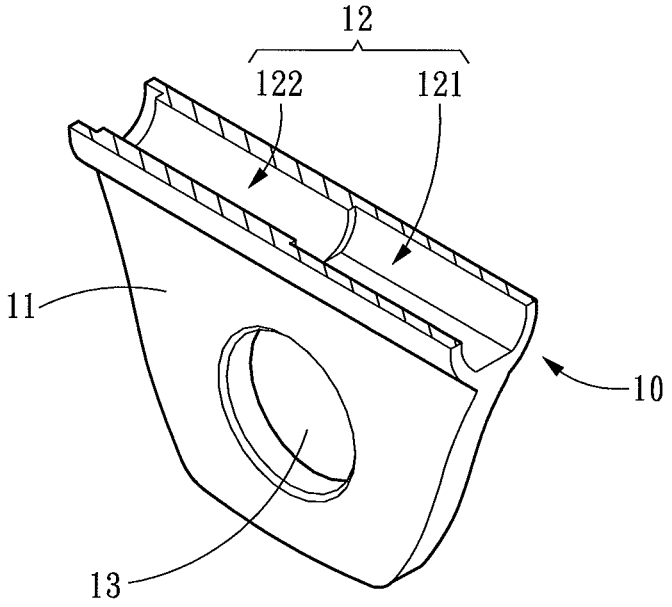
FIG. 6 is a sectional view of the bracket of the invention.

Please referring to FIG. 6, in order to form secured coupling between the bracket 10 and the connecting rod 40, this invention further includes a fastening strut 50 to bond one end of the passage 12 remote from the connecting rod 40, and also connect to the connecting rod 40. More specifically, the passage 12 includes a first connecting section 121 at one end abutting the winding shaft assembly 200, and a second connecting section 122 at another end remote from the winding shaft assembly 200 and communicating with the first connecting section 121. The connecting rod 40 includes a thread section 41 engaged with the winding shaft assembly 200 and a driven section 42 bonded to the first connecting section 121. The fastening strut 50 is bonded in the second connecting section 122 to connect to the connecting rod 40. Moreover, the first connecting section 121 has an opening formed in a shape corresponding to the driven section 42. In this embodiment the driven section 42 is formed in a semicircular shape.

Figure 7:
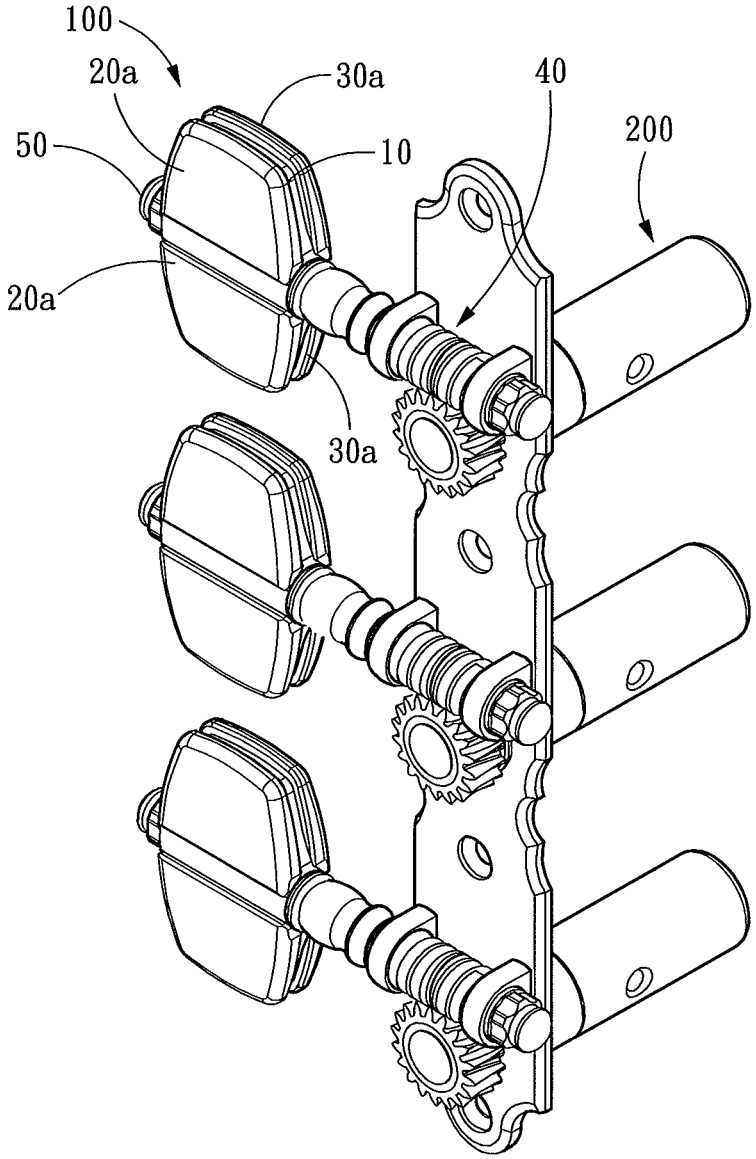
FIG. 7 is a perspective view of another embodiment of the invention.
Figure 8:
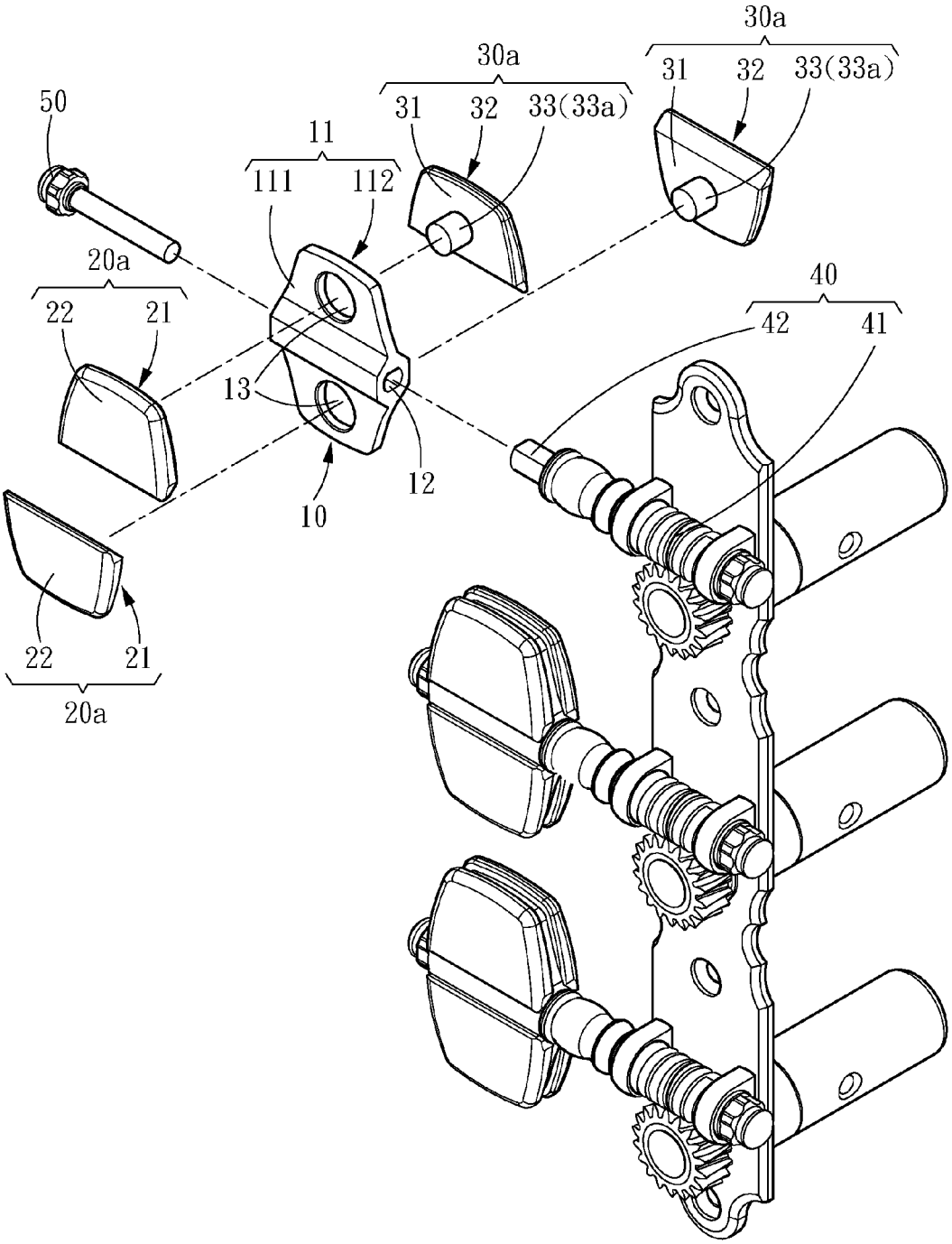
FIG. 8 is an exploded view of another embodiment of the invention.
Figure 9:
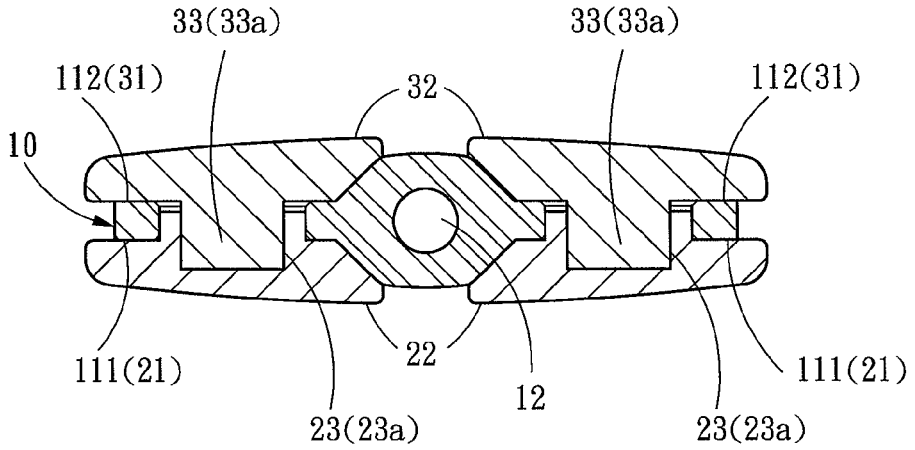
FIG. 9 is a fragmentary sectional view of another embodiment of the invention.

Please refer to FIGS. 7, 8 and 9 for another embodiment of the invention. The first panel 20 and the second panel 30 include respectively two sets. The two first panels 20*a* are located on the first side 111 symmetrical to the center of the passage 12, and the two second panels 30*a* are located on the second side 112 symmetrical to the center of the passage 12. In this embodiment each first panel 20*a* further includes a first installation portion 23, and each second panel 30*a* includes a second installation portion 33. Each first installation portion 23 runs through the installation hole 13 to couple with the corresponding second installation portion 33 so that the each first panel 20*a* and each second panel 30*a* are coupled tightly with the bracket 10. Through the two first panels 20*a* and the two second panels 30*a* users can freely select different materials to suit their preference to highlight their personal styles.

As a conclusion, the invention can provide features as follows:

1. Through the bracket the structural strength of the turning peg structure increases, hence it is less likely to be damaged because of external factors such as impact or dropping.

2. Through collaborating of the first ornamental portion and the second ornamental portion with the bracket, the turning peg structure not only has a stronger structural strength also can maintain the appeal in appearance.

3. By collaborating the first installation portions and the second installation portions with the installation holes the first panel and the second panel can be installed and changed easier, hence provide users the benefit of making personified decoration.

4. Through the two first panels and the two second panels, more diversified ornamental choices can be offered to the turning peg structure for the users.

What is claimed is:

1. A turning peg structure equipped with changeable faceplate to drive a winding shaft assembly of a string instrument to adjust tightness of a string, comprising:

a bracket including a plate and a passage embedded in and run through the plate, the plate including a first side and a second side opposite to the first side, wherein the bracket further includes two installation holes symmetric with respect to the passage;

at least one first faceplate disposed at the first side and including a first connecting portion connected to the bracket and a first ornamental portion at one side thereof remote from the bracket, wherein first faceplate further includes two first installation portions located on the first connecting portion and corresponding to the two installation holes, and the second faceplate further includes two second installation portions located on the second connecting portion and corresponding to the two first installation portions, the two first installation portions and the two second installation portions running through respectively the two installation holes to couple with each other;

at least one second faceplate disposed at the second side and including a second connecting portion connected to the bracket and a second ornamental portion at one side thereof remote from the bracket; and a linking rod including one end located in the passage and another end engaged with the winding shaft assembly.

2. The turning peg structure of claim 1, wherein the turning peg structure has two first faceplates and two second faceplates, the two first faceplates being symmetric with respect to the passage, and two second faceplates being symmetric with respect to the passage.

3. The turning peg structure of claim 1 further including a fastening strut bonded in one end of the passage remote from the linking rod and connected to the linking rod.

4. The turning peg structure of claim 3, wherein the passage further includes a first connecting section at one end adjacent to the winding shaft assembly and a second connecting section at another end remote from the winding shaft assembly communicating with the first connecting section, the linking rod including a thread section engaged with the winding shaft assembly and a driven section bonded in the first connecting section, the fastening strut being bonded in the second connecting section.

* * * * *